US005884737A

United States Patent [19]

Cabo

[11] Patent Number: 5,884,737

[45] Date of Patent: Mar. 23, 1999

[54] TRAVEL GARMENT BAG

[76] Inventor: Ricardo F. Cabo, P.O. Box 430754, San Diego, Calif. 92143

[21] Appl. No.: 855,332

[22] Filed: May 13, 1997

[51] Int. Cl.[6] ..... A45C 5/12; A45C 13/04; A45C 13/26

[52] U.S. Cl. ..... 190/109; 190/115; 190/119; 206/287; 224/578; 383/16

[58] Field of Search ..... 206/279, 287; 190/109, 110, 112, 115, 119; 383/16; 224/578

[56] References Cited

U.S. PATENT DOCUMENTS

| | | | |
|---|---|---|---|
| 1,751,936 | 3/1930 | Lowe | 190/119 X |
| 2,092,634 | 9/1937 | Binns | 205/287 X |
| 2,745,524 | 5/1956 | Plotkin | 383/16 X |
| 2,755,896 | 7/1956 | Breglia . | |
| 3,448,839 | 6/1969 | Lugash . | |
| 3,512,621 | 5/1970 | Teetor | 206/287 |
| 3,559,777 | 2/1971 | Gardner | 206/279 |
| 3,564,590 | 2/1971 | Hebel | 206/287 X |
| 3,612,232 | 10/1971 | Larson . | |
| 3,743,083 | 7/1973 | James | 206/287 |
| 3,831,740 | 8/1974 | Pendergast et al. | 206/287 X |
| 3,881,579 | 5/1975 | Keerdoja | 206/287 X |
| 3,929,224 | 12/1975 | Smith, Jr. | 206/287 |
| 4,062,429 | 12/1977 | Tabour et al. | 383/16 X |
| 4,091,976 | 5/1978 | Morse | 206/279 X |
| 4,134,479 | 1/1979 | Crider, Jr. . | |
| 4,153,146 | 5/1979 | Patton et al. | 383/16 X |
| 4,193,482 | 3/1980 | Koff | 206/287 |
| 4,390,087 | 6/1983 | Goldfinger | 206/287 |
| 4,693,345 | 9/1987 | Mittelmann . | |
| 4,826,060 | 5/1989 | Hollingsworth | 383/16 X |
| 4,951,816 | 8/1990 | Smith | 190/112 X |
| 5,060,795 | 10/1991 | Bomes et al. | 206/287 X |
| 5,209,327 | 5/1993 | Wright et al. . | |
| 5,323,897 | 6/1994 | Sperber | 206/287 |
| 5,375,685 | 12/1994 | Plath | 190/115 X |
| 5,547,052 | 8/1996 | Latshaw | 190/115 X |

FOREIGN PATENT DOCUMENTS

| | | |
|---|---|---|
| 366 | 3/1995 | Mexico . |

*Primary Examiner*—Sue A. Weaver
*Attorney, Agent, or Firm*—Jāgtiani & Associates

[57] ABSTRACT

In one aspect, the present invention provides a travel garment bag having a cover with an opening through which items to be carried within the bag may be inserted; a wire box inflexible frame enclosed within and supporting the cover; and a hanging strap attached to the inflexible frame and capable of extending through a second opening in a top wall of the cover. The hanging strap includes a strap having a hook and ring attached to opposite ends thereof. In order to hang the garment bag on a horizontal rod, such as a closet rod, the strap is wrapped around the rod and the hook is hooked on the ring.

13 Claims, 3 Drawing Sheets

TRAVEL GARMENT BAG

BACKGROUND OF THE INVENTION

1. Field of the Invention

The present invention relates generally to garment bags for use when traveling.

2. Description of the Prior Art

Most travel garment bags have been designed primarily for items such as suits and shirts that can be conveniently hung on hangers. However, there are many clothing items such a underwear, socks, handkerchiefs, folded shirts, etc. which are not readily used with hangers. When such small items are placed in a conventional garment bag, they tend to collect in one large mass at the bottom of the bag and become disordered. Therefore, there exists a need for a travel garment bag which can be used to carry such small items of clothing so that they do not become disordered during traveling.

SUMMARY OF THE INVENTION

It is therefore an object of the present invention to provide a rigid travel garment bag for small items that can be easily carried and which will prevent its contents from being rearranged while it is being carried.

It is a further object of the present invention to provide a travel garment bag for non-hanging items that can be hung on a closet rod or other similar place where clothing is hung.

It is a yet further object of the present invention to provide a travel garment bag with an improved exterior pouch.

In one aspect, the present invention provides a travel garment bag having a cover with an opening through which items to be carried within the bag may be inserted; a wire box inflexible frame enclosed within and supporting the cover; and a hanging strap attached to the inflexible frame and capable of extending through an opening in a top wall of the cover. The hanging strap includes a strap having a hook and ring attached to opposite ends thereof. In order to hang the garment bag on a horizontal rod, such as a closet rod, the strap is wrapped around the rod and the hook is locked on the ring.

In another aspect, the present invention provides a travel garment bag having a cover with an opening through which items to be carried within the bag may be inserted and a wire box inflexible frame enclosed within and supporting the cover. The inflexible frame includes at least two horizontal rods extending across the frame from supporting members on one side wall of the frame to supporting members on the other side wall of the frame for supporting items hung thereon; and a device for hanging the garment bag on a horizontal rod, such as a closet rod.

In another aspect, the present invention provides a travel garment bag having a cover with an opening through which items to be carried within the bag may be inserted; a wire box inflexible frame enclosed within and supporting the cover; a pouch on the cover supported by a polygonal reinforcing member; and a device for hanging the travel garment bag on a horizontal rod, such as a closet rod.

Other objects and features of the present invention will be apparent from the following detailed description of the preferred embodiment.

BRIEF DESCRIPTION OF THE DRAWINGS

The invention will be described in conjunction with the accompanying drawings, in which.

DETAILED DESCRIPTION OF THE PREFERRED EMBODIMENT

Figure 1:
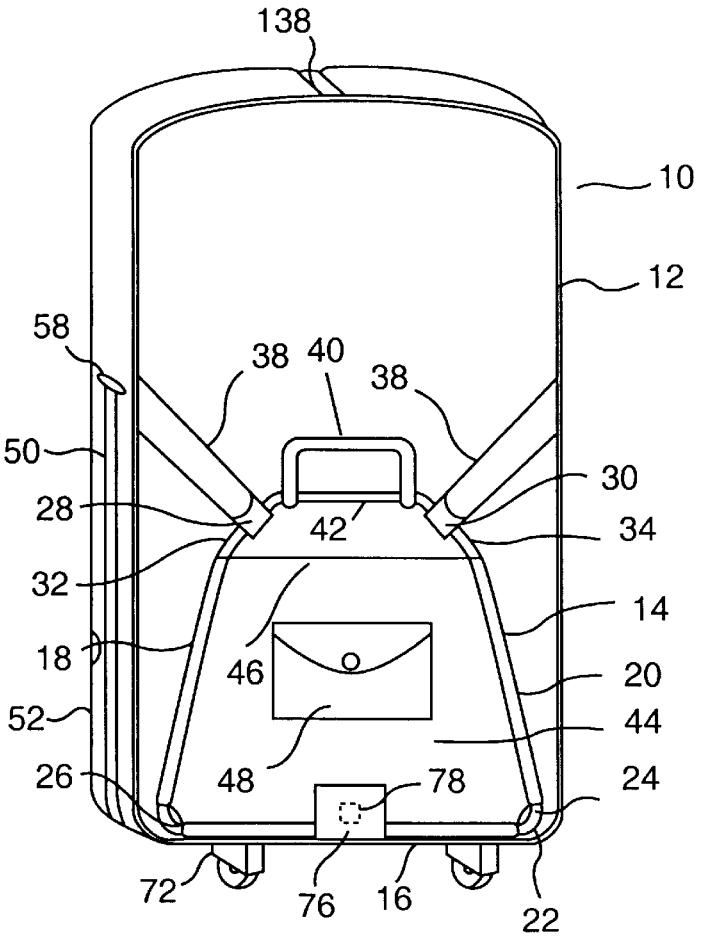
FIG. 1 is a front perspective view of one embodiment of the travel garment bag of the present invention.

FIG. 1 shows the front side of a preferred embodiment of a travel garment bag 10 made according to the invention having a cover 12 made of a typical natural or man-made garment bag material such as imitation leather, leather, canvass, etc. A six-sided tapering reinforcement 14 is mounted on the cover 12 by means of a bottom channel 16 and two shoulder channels 18 and 20 fixed to the cover 12. Channels 16, 18 and 20 cover a bottom rod 22, and two lower shoulder rods 24 and 26, respectively, of the reinforcement 14. The reinforcement 14 can be made of any sturdy material such as metal or plastic. Although the reinforcement 14 is preferably made in one piece, it can also be made in multiple pieces which are attached together after they have been inserted through the channels 16, 18, and 20. The reinforcement 14 is additionally held to the cover 12 by two upper shoulder channels 28 and 30 which cover upper shoulder rods 32 and 34 of the reinforcement 14. Upper shoulder channels 28 and 30 are attached to the cover 12 by diagonal straps 36 and 38, respectively, which are attached along their lengths to the cover 12, preferably by sewing. A handle 40 is rotatably attached to a top rod 42 of reinforcement 14 thereby allowing the handle 40 to rotate away from the cover 12. The handle 40 is a conventional handle of the type used for suitcases or briefcases and can be made of a manmade material such as plastic or natural material such as leather.

Figure 10:
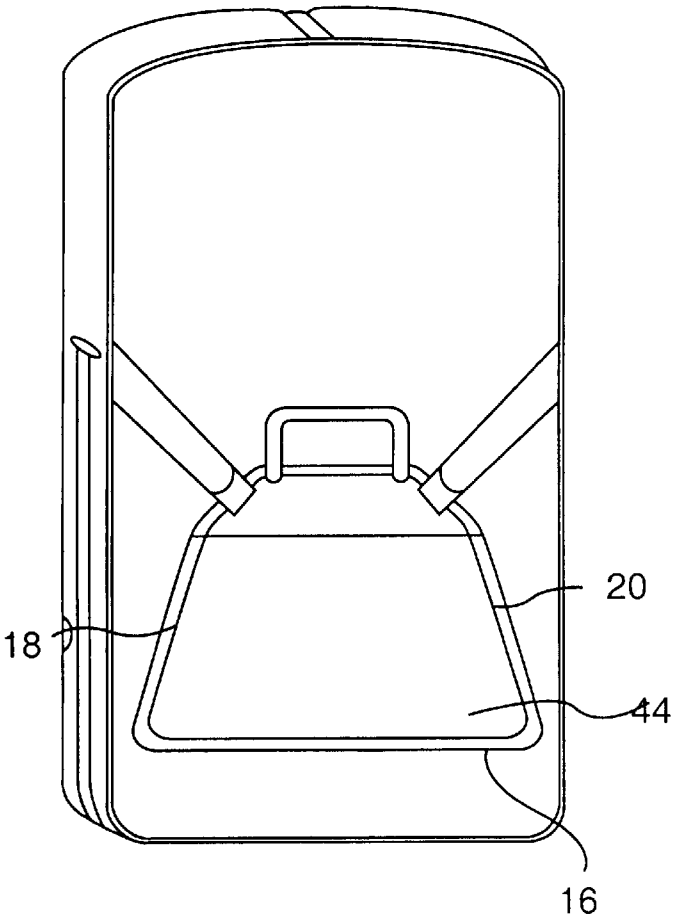
FIG. 10 is a front perspective view of an alternative embodiment of the travel garment bag.

Stretched between the channels 16, 18 and 20 is a membrane 44 which is preferably made of the same material as the rest of the cover 12 and lies over a portion of the cover 12 to form a compartment having an opening 46. The compartment may be sealed shut using a piece of Velcro® on the interior of the lip of opening 46 (not visible in FIG. 1). Although the channels 16, 18, and 20 can be made separately from the membrane 44, in a preferred embodiment of the invention, the channels 16, 18 and 20 are formed during the process of attaching the membrane 44 to the cover 12. On top of the membrane 44 there may be fixed an additional pouch 48. In another embodiment, shown in FIG. 10 the bottom channel 16 and, therefore, also, the membrane 44 may be displaced several centimeters from the bottom of the cover 12. In addition, as shown in FIG. 10, channels 16, 18 and 20 may totally enclose rods 22, 24 and 26, respectively.

Figure 2:
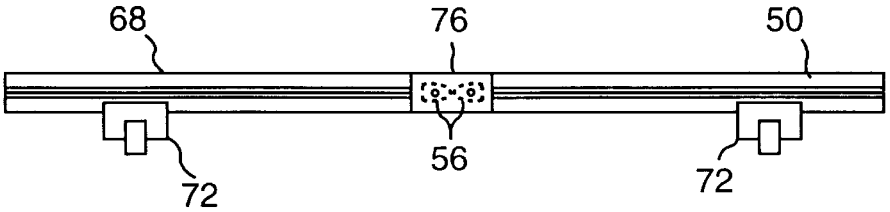
FIG. 2 is a bottom view of the travel garment bag of FIG. 1.
Figure 4:
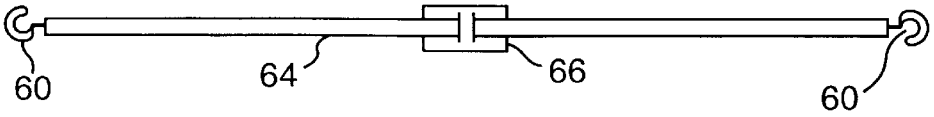
FIG. 4 is a top view of a shoulder strap for the travel garment bag of FIG. 1, shown detached from the travel garment bag.
Figure 8:
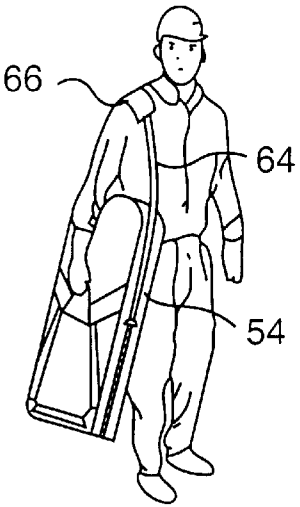
FIG. 8 shows a user holding the travel garment bag of FIG. 1.

The cover 12 includes a zipper track 50 which extends from slightly over midway up one side wall 52 of the cover 12, along the bottom of the bag, as shown in FIG. 2, and up an opposite side wall 54 of the cover 12 as shown in FIG. 8. The zipper track 50 may be equipped with two heavy duty zippers 56, shown by shadow lines in FIG. 2, for opening and closing the cover 12 to allow clothing (not shown) and other items stored in the travel garment bag 10 to be removed. Near the end of each end of the zipper track 50 is a metal semicircular retaining ring 58 for retaining respective hooks 60 of a shoulder strap 64 (shown in FIG. 4). The shoulder strap 64 also includes a cushioning pad 66 which rests against the shoulder of the user when the bag is being carried, as shown in FIG. 8.

Figure 3:
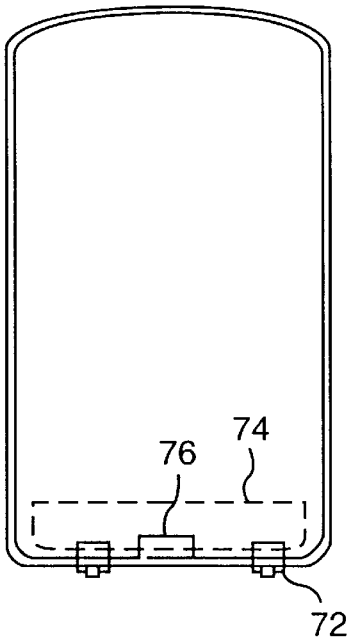
FIG. 3 is a back view of the travel garment bag of FIG. 1.

In a preferred embodiment, on the bottom wall 68 of the cover 12 wheels 72 are provided which allow the garment bag 10 to be dragged behind the user or pushed in front of the user. These wheels are of the conventional type used for rolling suitcases and carts and can be attached to the garment bag in a conventional manner such as by mounting them at the bottom of a metal frame 74 mounted in the back of the cover 12 (shown by shadow lines in FIG. 3). A flap 76 may also be provided for covering the two zippers 56 where they meet on the bottom wall 68 of the cover 12. The flap 76 is fixed in place once the zipper track 50 is closed by the zippers 56 by means of a conventional latch, buckle or piece of Velcro® 78 (shown by shadow lines).

Figure 5:
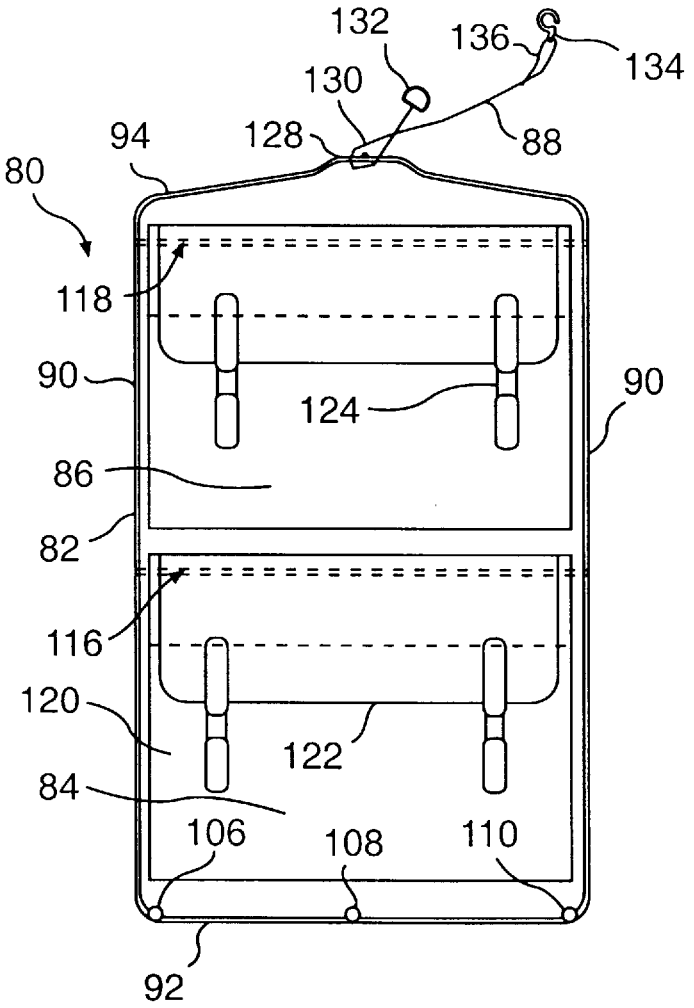
FIG. 5 is a front view of an interior structure mounted inside the garment bag of FIG. 1 with two removable bags mounted thereon.
Figure 6:
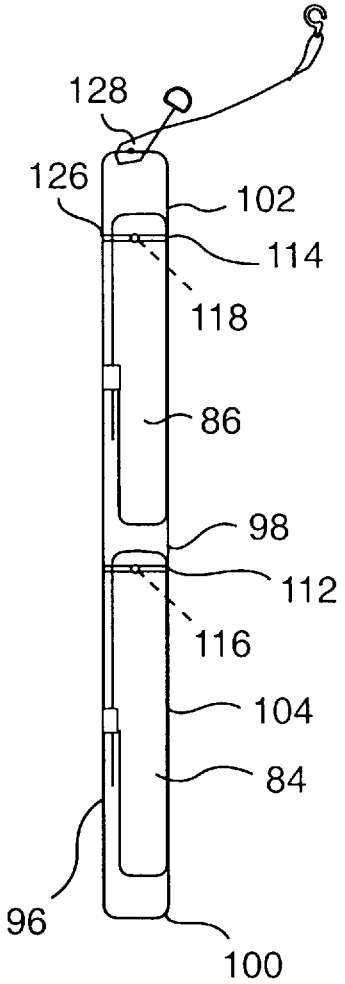
FIG. 6 is a side view of the interior structure of FIG. 5.

FIGS. 5 and 6 show an interior structure 80 of the travel garment bag 10. The interior structure 80 consists of a wire box inflexible frame 82, two interior bags 84 and 86, and a hanging strap 88. The inflexible frame 82, which is made of a rigid and sturdy material such as metal or hard plastic, is located within and supports the cover 12 of the travel garment bag 10.

For the purposes of the present invention, the term "wire box" when used with reference to the wire box inflexible frame 82 includes not only a box made of metal wire, but a box made of rods of rigid materials such as metal, plastic and wood. The term "wire box" is used to denote the fact that the inflexible frame is a cage-like structure as opposed to a solid-sided structure, such as a shoe box.

As shown in FIGS. 5 and 6, the inflexible frame 82 includes two front vertical rods 90. The front vertical rods 90 are connected at their bases by a front bottom horizontal rod 92. Attached to the front vertical rods 90 is a tapered front top portion 94. Together the two front vertical rods 90, the front bottom horizontal rod 92 and the front top portion 94 form a front frame structure 96. The inflexible frame 80 also includes two back vertical rods 98 (only one of which is visible in FIG. 6) connected to each other by a back bottom horizontal rod 100. Attached to the back vertical rods 98 is a back top portion 102. Together the back vertical rods 98, the back bottom horizontal rod 100 and back top portion 102 form a back frame structure 104. Front frame structure 96 is connected to back frame structure 104 by three bottom connecting rods 106, 108 and 110, two lower side wall rods 112, and two upper side wall rods 114 (only one of each pair of side wall rods is visible in FIG. 6) to form the inflexible frame 82.

The two lower side wall rods 112 support a lower intermediate horizontal rod 116 (shown by a dashed line in FIG. 5) that extends from an intermediate position on one of the lower side wall rods 112 to an intermediate position on the other lower side wall rod 112. Similarly, the two upper side wall rods 114 support an upper intermediate horizontal rod 118 (shown by a dashed line in FIG. 5) that extends from an intermediate position on one of the upper side wall rods 114 to an intermediate position on the other upper side wall rod 114. Lower and upper intermediate horizontal rods 116 and 118 support interior bags 84 and 86, respectively. Each of the interior bags 84 and 86 is comprised of a suitable natural or man-made material of the same type or a different type from the material used for the cover 12. As shown, each interior bag includes a body portion 120, a flap 122 and two buckles 124. In order to hang an interior bag on one of the intermediate horizontal rods 116 and 118, the flap 122 is folded around the intermediate horizontal rod and buckled to the body portion 120 by means of the buckles 124. The interior bags 84 and 86 are designed so that when they are closed and buckled by buckles 124, there is an opening 126 on each side of the bag through which one of the intermediate horizontal rods can extend.

Figure 7:
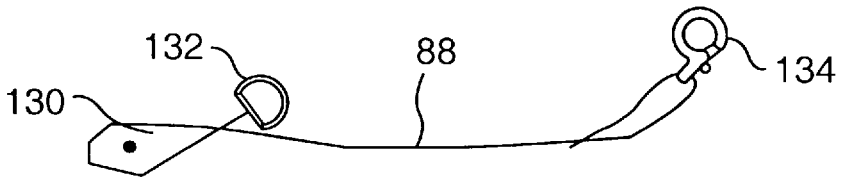
FIG. 7 is an enlarged view of a hanging strap of the interior structure of FIGS. 5; and 6.

Connecting front top portion 94 and back top portion 102 is a top connecting rod 128. Looped around the connecting rod 128 is a ring loop 130 of the hanging strap 88. Attached to the hanging strap 88 near the ring loop 130 is a semicircular strap ring 132. At the other end of the hanging strap 88 is a strap hook 134 attached to the strap 88 by means of a hook loop 136. The hanging strap extends through an opening 138 (shown in FIG. 1) in the top of cover 12. When not in use, the strap hook 134 is hooked on a semicircular ring 58 on the cover 12 (shown in FIG. 1). The travel garment bag 10 can be hung on a horizontal rod, such as a clothes rod in a closet, by wrapping the strap 88 around the rod until almost all of the strap 88 is used up and then fastening the strap 88 in place by hooking the strap hook 134 to the strap ring 132. As can be more easily seen in FIG. 7, the strap hook 134 is preferably the type of hook which can be opened and closed by pressing and releasing a button on the hook 134.

Other clothing can be hung in the travel bag in addition to the two interior bags 84 and 86. For example, pants may be hung on top of interior bag 86 which is hung on the upper intermediate horizontal rod 118 which extends through the opening 126. Suits, shirts and other clothing on hangers can be hung from the connecting rod 128. Alternatively, a jacket may be hung over the entire inflexible frame 82 before inserting the inflexible frame 82 inside the cover 12.

FIG. 8 shows a user carrying the travel garment bag of the invention. The user carries the garment bag 10 under his arm by grasping the handle 40 and extending his arm through the shoulder strap 64 so that the cushioning pad 66 rests on his shoulder and the garment bag rests next to the user's hip.

Figure 9:
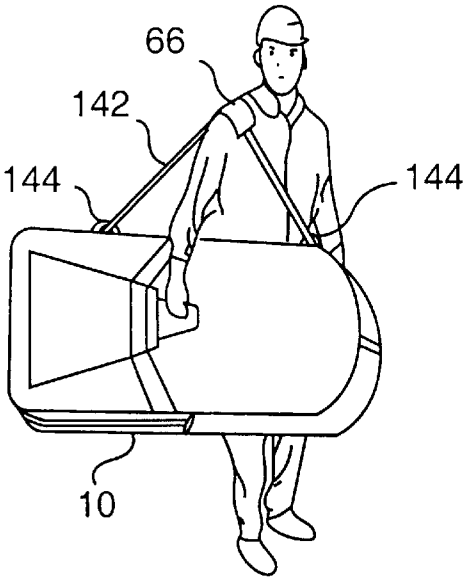
FIG. 9 shows a user holding a travel garment bag of an alternative embodiment of the invention.

FIG. 9 shows another embodiment of the travel garment bag of the invention in which a shoulder strap 142, similar to shoulder strap 64, is hooked on to two semicircular rings 144 mounted on the side of the bag. This arrangement allows a user to carry the travel garment bag 10 in a horizontal position.

Although particular types of rings and hooks are described in the present application, it should be understood that the use of various other types of conventional ring and hook combinations are contemplated by the invention.

Although the present invention has been fully described in conjunction with the preferred embodiment thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed:

1. A travel garment bag comprising:

a cover having two facing body portions, two long side walls and two short side walls which connect said two body portions to form an enclosure, and a first opening through which items to be carried within said enclosure of said bag may be inserted, each of said long and short side walls being narrower in width than each of said two body portions, each of said long side walls being longer than each of said short side walls, and each of said long side walls extending in a substantially horizontal direction when said bag is carried in a horizontal direction and extending in a substantially vertical direction when said bag is carried in a vertical direction;

a wire box inflexible frame enclosed within and supporting said cover;

a shoulder strap attached at two points on one of said long side walls of said cover for carrying said bag under a user's arm when said bag is carried in a horizontal direction with said shoulder strap over a user's shoulder; and a handle mounted on one of said body portions of said cover which can be grasped by a user when said travel garment bag is carried under a user's arm in either a horizontal or vertical direction.

2. The travel garment bag of claim 1, further comprising:

a pouch mounted on one of said body portions of said cover supported by a reinforcing member along base and side walls of said pouch, said pouch being in the shape of a trapezoid in which the base and top of the trapezoid are parallel to at least one of said short side walls of said cover, and said pouch having an opening at the top of the trapezoid.

3. The travel garment bag of claim 2, further comprising:

a hanging strap attached to said inflexible frame and capable of extending through a second opening in a top wall of said cover, said hanging strap including a strap hook means and a strap ring means attached to opposite ends of said hanging strap for engaging each other when said hanging strap is wrapped around a horizontal rod to allow the garment bag to be hung on the horizontal rod.

4. A travel garment bag according to claim 3, further comprising supplemental ring means attached to said cover for engaging said hook means when said hook means is not engaged with said strap ring means.

5. The travel garment bag of claim 2, wherein said inflexible frame includes at least two horizontal rods, each of said at least two horizontal rods extending across said inflexible frame from a supporting member on one side wall of said inflexible frame to a supporting member on the other side wall of said inflexible frame for supporting an item hung thereon.

6. A travel garment bag according to claim 5, further comprising an interior bag having two openings through which at least one of said at least two horizontal rods extends to support said interior bag within said travel garment bag.

7. A travel garment bag according to claim 5, further comprising at least two interior bags, each of said two interior bags having two openings through which at least one of said at least two horizontal rods extends to support a respective interior bag within said travel garment bag.

8. A travel garment bag according to claim 2, wherein said reinforcing member comprises a six-sided rod structure including:

a bottom rod;

two lower shoulder rods extending upwards and towards each other from said bottom rod;

two upper shoulder rods, each said upper shoulder rod extending at an angle towards the other upper shoulder rod from a respective one of said two lower shoulder rods; and a horizontal top rod connecting said two upper shoulder rods.

9. A travel garment bag according to claim 8, wherein said handle is rotatably mounted on said top rod of said reinforcing member.

10. A travel garment bag according to claim 8, wherein said cover further comprises seams through which said bottom rod, lower shoulder rods, and upper shoulder rods extend to fix said reinforcing means on said cover, said seams defining the edges of said pouch.

11. The travel garment bag of claim 2 further comprising wheel means mounted on a bottom one of said short walls of said cover.

12. The garment bag of claim 1, further comprising two zippers mounted on zipper tracks on two of said long side walls and one of said short side walls for opening and closing said first opening and a covering flap mounted on one of said body portions and releasably attached to the other of said body portions for covering said two zippers when said first opening is closed by said zippers.

13. The garment bag of claim 1, wherein said covering flap is releasably attached to said other of said body portions by Velcro®.

* * * * *